United States Patent [19]

Wada et al.

[11] Patent Number: 5,056,275

[45] Date of Patent: Oct. 15, 1991

[54] CONTINUOUSLY-OPERABLE ABRASIVE BLASTING APPARATUS

[75] Inventors: Hirokazu Wada; Nagio Minami; Tamotsu Oka, all of Hiroshima, Japan

[73] Assignee: Mitsubishi Jukogyo Kabushiki Kaisha, Tokyo, Japan

[21] Appl. No.: 497,612

[22] Filed: Mar. 23, 1990

[30] Foreign Application Priority Data

Apr. 17, 1989 [JP] Japan ..... 1-44082[U]

[51] Int. Cl.[5] ..... B24C 7/00; B24C 9/00

[52] U.S. Cl. ..... 51/437; 51/424

[58] Field of Search ..... 51/424, 425, 436, 437, 51/438

[56] References Cited

U.S. PATENT DOCUMENTS

| | | | |
|---|---|---|---|
| 699,405 | 5/1902 | Newhouse | 51/437 |
| 1,605,732 | 11/1926 | Hoevel | 51/437 |
| 2,597,434 | 5/1952 | Bishop | 51/425 X |
| 2,810,991 | 10/1957 | Mead | 51/425 |

FOREIGN PATENT DOCUMENTS 61-2562 1/1986 Japan .

*Primary Examiner*—Frederick R. Schmidt
*Assistant Examiner*—Bruce P. Watson

[57] ABSTRACT

A hydraulic blasting apparatus has an abrasive storage tank disposed operatively between an abrasive recovery tank and a hydraulic pressurized tank. The abrasive storage tank is provided with a first valve openable from the inside of the storage tank to the atmospheric pressure, and also with a second valve to open the connection between the storage tank and the recovery tank and with a third valve to open the connection between the storage tank and the pressurized tank. The pressure in the abrasive storage tank will become the same as the atmospheric pressure by opening the first valve. Next the first and second valve are closed, and after that the third valve is opened so as to drop the abrasive only into the pressurized abrasive tank for a recycle use.

11 Claims, 5 Drawing Sheets

CONTINUOUSLY-OPERABLE ABRASIVE BLASTING APPARATUS

FIELD OF THE INVENTION AND RELATED ART STATEMENT

The present invention relates in general to a blasting apparatus, and more particularly to a hydraulic blasting apparatus of local type for use in the surface preparation prior to painting operation of a work such as the steel structure in an iron bridge and the like.

As in FIG. 1 by way of a typical example, a known hydraulic abrasive blasting machine of local vacuum type is designed specifically for use in the abrasive grinding and cleaning operation for the purpose of removing metal rust or blisters prior to the painting work on the structure such as an iron bridge or smokestack under construction and/or removing metal rust or unstable paint film or paint blisters during the maintenance work of such structures.

In the drawing figure, it is seen that abrasive grain A contained in a pressurized container tank a is fed under compressed air b through a blast hose c to a blast nozzle d, from which the abrasive grain is shot externally onto the surface or spot to be ground B of a work like a steel structure where metal rust and/or paint blisters are to be removed prior to a following step in the operation.

Pieces or flakes of metal rust and/or paint removed will be sucked together with used abrasives under negative pressure from a blower e and delivered by way of an ejection hose f back to a recovery tank g, where abrasives are classified from metal rust and/or paint dust, and then abrasive A is accumulated in the recovery tank g and the remaining dust is fed further to a filter tank h to be stored therein for a disposition to follow.

The abrasive grinding and cleaning work may be conducted in continuation and frequency as long as the abrasive grain A is available in stock within the pressurized tank a. When there is no stock of abrasives A in the pressurized tank a, the grinding operation is to be interrupted once for recharging abrasives. For this service, the inside pressure of the tank a is to be firstly removed so that there is no differential pressure between the pressurized tank a and the recovery tank g, and then a valve i which closes the bottom of the recovery tank g is opened so that abrasives A classified and accumulated for recycle use in the inside of the recovery tank g may be discharged down to the pressurized tank a. Also shown is a valve j which is disposed on the bottom of the pressurized tank a, and which is adapted to be opened by a start-of-operation signal and closed by an end-of-operation signal, respectively.

Incidentally, according to a typical blasting machine of conventional construction, the operation period of time would depend generally upon the volume or capacity of abrasives to be stocked in the pressurized tank, and consequently, in order to practice the grinding and cleaning operation for a long continued period of service, it was essentially required to design the pressurized tank a with a large abrasive storage capacity, and so this requirement would unavoidably lead to a large sized installation. In general working fields, however, there are commonly such inconveniences and complaints as restricted use of a crane, narrow scaffoldings, widely scattered working areas, and the like, and then such a large sized blasting machine may occasionally fail in services in view of its cumbersomeness or heavy weight and large dimensions. In contrast, in case of a small sized blasing machine which has naturally a pressurized tank A of small storage capacity of abrasives, this machine could only be serviceable for a shorter period of work or at a short interval, which would result in an inefficient operation.

OBJECT AND SUMMARY OF THE INVENTION

It is a primary object of the present invention to provide an improved hydraulic blasting apparatus which can serve a continuous blasting and cleaning operation with a small size of machine and with a high efficiency of operation as compared to with a larger capacity installation.

In an attempt to attain the object as noted above, there is provided an improvement in and relating to a hydraulic blasting and cleaning apparatus of continuously-operable type which comprises in combination, as summarized in brief, an abrasive recovery tank means, a hydraulic pressurized abrasive tank means, the former being located above the latter, and an abrasive storage tank means disposed between the abrasive recovery tank means and the pressurized tank means so that the storage tank means is in communication with both the recovery tank means and pressurized tank means and so that the storage tank means is opened to the atmospheric pressure via a first valve means, the storage tank means comprising a second valve means and a third valve means disposed in opposed relationship with each other therein, the second valve means being adapted to open the operative connection between the storage tank means and the recovery tank means, the third valve means being adapted to open the operative connection between the storage tank means and the pressurized tank means, and a control means adapted to control independently the operation of the first, second and third valve means.

The above and other objects and advantages of the invention can be understood better from, when read, the following detailed description by way of a preferred embodiment of a hydraulic blasting apparatus improved in accordance with the present invention as described with reference to the accompanying drawings. It should be understood that the detailed description and specific examples, while indicating preferred embodiments of the invention, are given by way of illustration only, since various changes and modifications within the spirit and scope of the invention will become apparent to those skilled in the art from this detailed description. In the detailed description of the present invention to follow, reference is made to the accompanying drawings, in which like parts are designated by like reference numerals.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIGS. 4A and 4B are illustrative representations showing the operation of a hydraulic blasting apparatus of the invention; in which FIG. 4A is a timing chart showing the timing of operations of a hydraulic blasting apparatus of the invention; and FIG. 4B–4G shows a series of cross-sectional schematic views showing the valving operation of a hydraulic blasting apparatus of the invention.

DETAILED DESCRIPTION OF A PREFERRED EMBODIMENT

In the following, the present invention will now be described in greater detail by way of a preferred embodiment thereof shown in FIG. 2.

Figure 1:
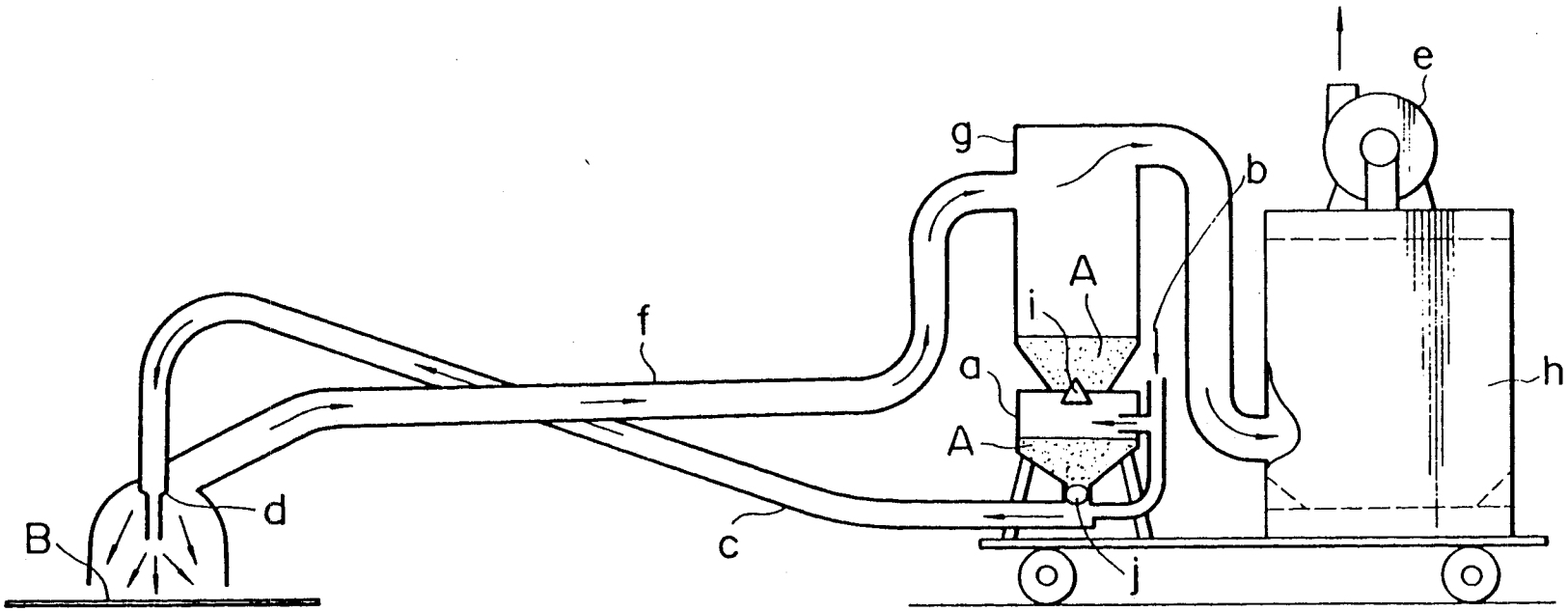
FIG. 1 PRIOR ART
FIG. 1 is a general schematic view showing, in cross section, the typical construction of a conventional hydraulic blasting machine.
Figure 2:
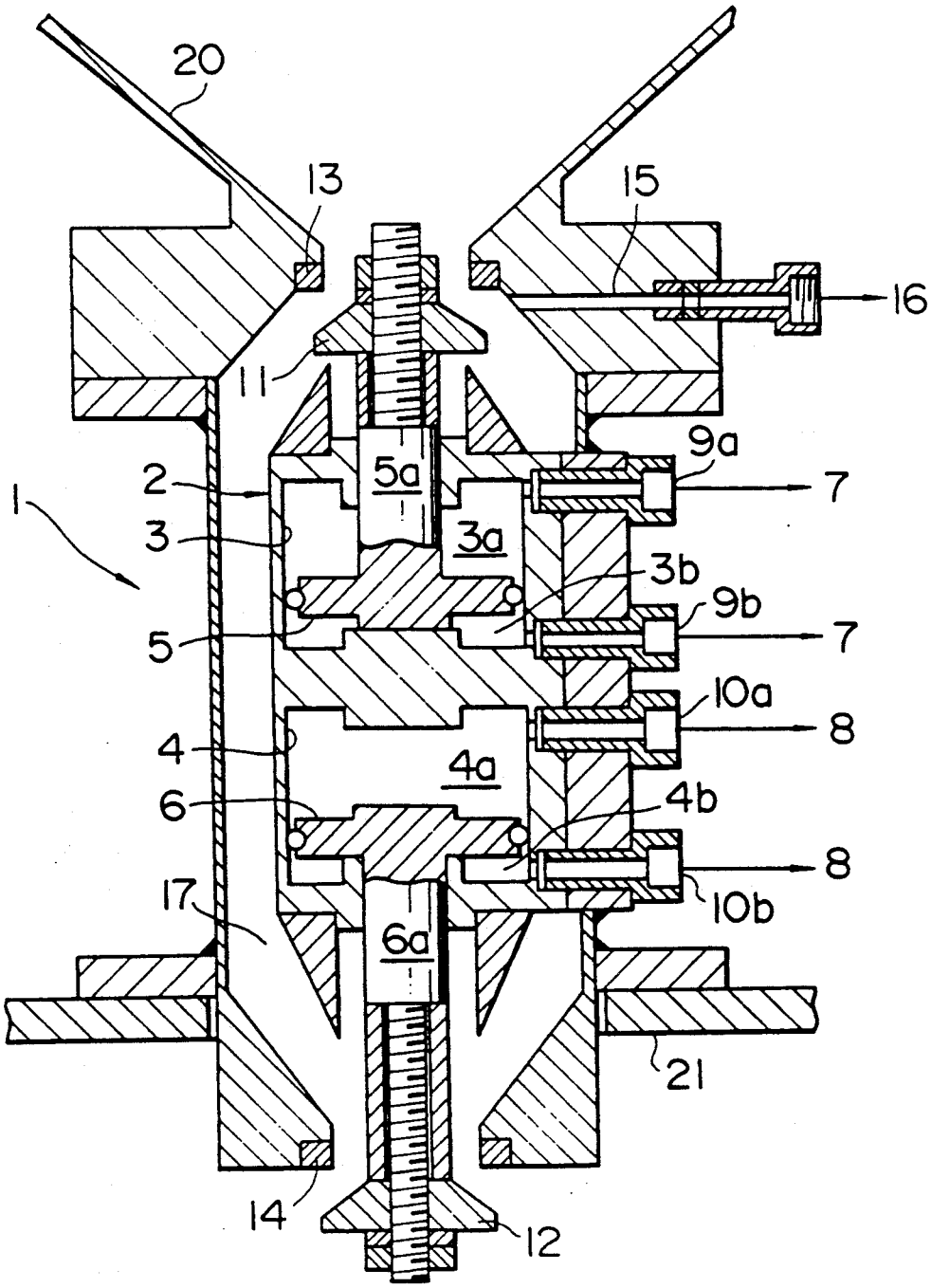
FIG. 2 is an enlarged cross-sectional side elevational view showing a valving mechanism for use in a hydraulic blasting apparatus according to the present invention.
Figure 3:
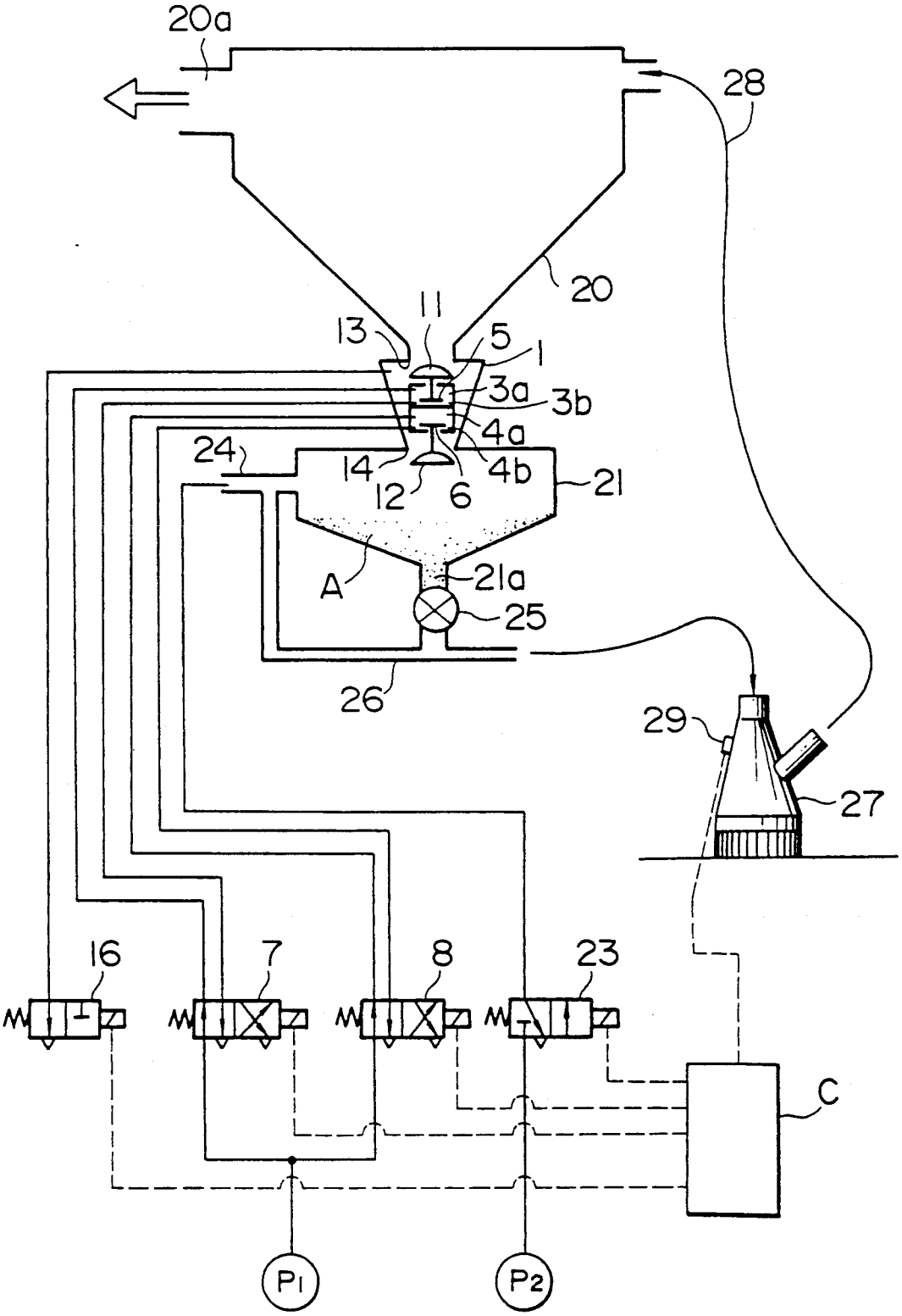
FIG. 3 is a general circuit diagram showing schematically the general circuit arrangement of a hydraulic blasting apparatus of the invention.

As shown in cross section in FIG. 2, a hydraulic blasting apparatus according to the present invention comprises an abrasive grain reservoir space or storage tank designated at a reference numeral 1, which is disposed mid-way or intermediate between an abrasive recovery tank 20 for the recovery of abrasive grain and a pressurized abrasive tank 21. In the middle center of this storage tank 1, a cylinder housing 2 is provided, in which housing two cylinder sections 3 and 4 are defined in serial fashion one upon another as viewed in the drawing figure. In the inside of these cylinder sections 3 and 4, valve pistons 5 and 6, respectively, are provided in such a manner that each of these valve pistons are slidably shiftable independently from each other along the longitudinal axis of the cylinder section. There are defined spaces or chambers **3*a* and 3*b* by the valve piston 5 within the cylinder section 3, which may be connected selectively to a pressure source $P_1$ or to the atmosphere by way of an electromagnetic shift valve 7, while there are likewise defined spaces or chambers 4*a* and 4*b* by the valve piston 6 within the cylinder section 4, which may also be connected selectively to a pressure source $P_1$ or to the atmosphere by way of an electromagnetic shift valve 8, as generally shown in FIG. 3, respectively. Supply or charge of air to and exhaustion or discharge of air from these chambers 3*a*, 3*b* and 4*a*, 4*b* are performed by the shift valves 7 and 8 by way of connections through joints 9*a*, 9*b* and 10*a*, 10*b***, respectively.

Also, shown are piston rods **5*a* and 6*a* of the valve pistons 5 and 6 extending outwardly in the opposite directions from each other as viewed in the figure, and mounted securely at the leading free ends of these piston rods 5*a* and 6*a* are valve elements 11 and 12**, respectively.

The valve element 11 is adapted to open and close the connection or flow of abrasives between the recovery tank 20 and the storage tank 1, while the valve element 12 is adapted to likewise function in the connection between the pressurized tank 21 and the storage tank 1. More specifically, these valve elements 11 and 12 are caused to shift in sliding motion along the axis of the cylinder against the valve seats 13 and 14, respectively, by the driving motion of the valve pistons 5 and 6, so as to close the connections hermetically or in an air-tight fashion. There is provided a vent 15 to function in such a manner that the connection between the recovery tank 20 and the abrasive storage tank 1 may be put through to the atmosphere by way of an electromagnetic stop valve 16. There is also defined in the abrasive storage tank 1, a space 17 for temporarily reserving or for allowing the flow of abrasives in the cylinder housing 2 and around the valve elements 11 and 12.

As shown in FIG. 3, the pressurized abrasive tank 21 has a connection or piping 24 from an air supply source $P_2$ by way of an electromagnetic shift valve 23. There is also provided a regulating valve 25 at the bottom of the pressurized abrasive tank 21, which is adapted to adjust the flow rate of abrasives. An abrasive feed hose 26 is provided extending in branch from piping 24 and with its leading end being connected to a blast gun 27. This feed hose 26 is operatively connected at mid-way to an outlet **21*a* of the pressurized tank 21 through the flow rate regulating valve 25**.

There is also connected an ejection hose 28 between the blast gun 27 and the abrasive recovery tank 20, with the outlet **20*a* of the recovery tank 20** being connected to a suction device not shown. In this figure, abrasives are designated by the reference character A and a controller by C, respectively.

In operation of this abrasive blasting apparatus, the electromagnetic shift valve 23 may be operated in shifting motion by the manipulation of a switch 29 which is provided on the part of the blast gun 27 or else, so as to operatively put the abrasive feed hose 26 in communication with the pressure source $P_2$, and concurrently by opening the flow rate regulating valve 25 to cause abrasives A within the pressurized tank 21 to be fed through the abrasive feed hose 26, thereby to force abrasives A towards the blast gun 27. Used abrasives A shot from the blast gun 27 will be delivered together with metal rust and/or paint dust peeled off from the working surface of a work or structure by way of the ejection hose 28 to the recovery tank 20, where waste abrasives A are separated from such dust for a recycle use. Then, thus-recovered abrasives A accumulate on the bottom of the recovery tank 20, and remaining dust is to be discharged externally of the tank 20 by way of the outlet **20*a***.

Figure 4A:
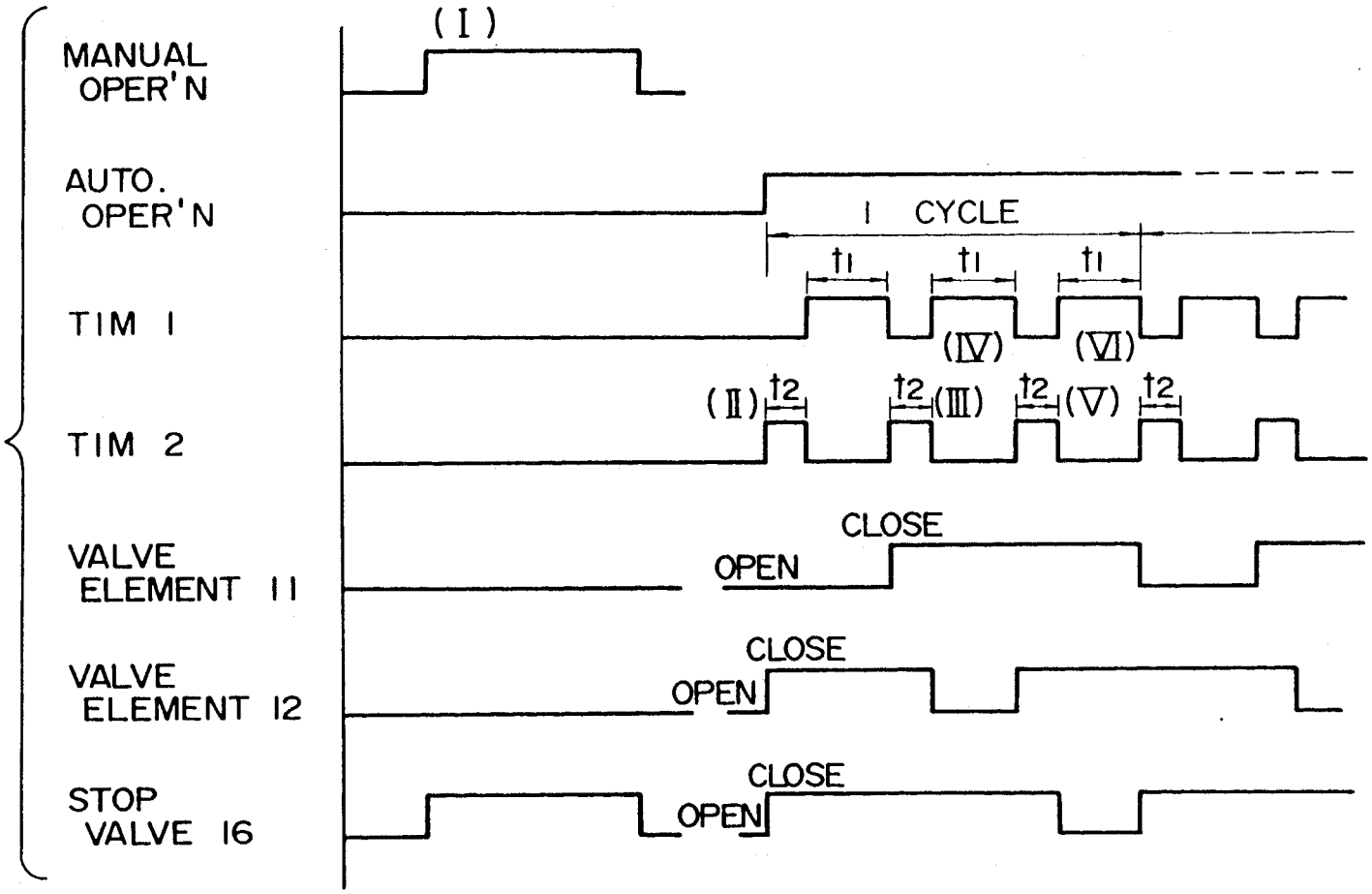

Next, referring further to the operation of involved elements within the abrasive storage tank 1 which occurs during the blasting and cleaning operation by the continuous workable type hydraulic blasting apparatus of the present invention in conjunction with FIG. 4, there is shown the timing chart on the operations per working cycle in a continuous blasting operation in FIG. 4A, while FIG. 4B–4G shows a series of operating positions of the valves involved in the blasting operation positions.

In operation, upon the turning-on of a manual switch such as a power source switch not shown, the chambers **3*a* and 4*a* of the cylinder sections 3 and 4 are operatively put into communication with the pressure source $P_1$, and concurrently the chambers 3*b* and 4*b* are opened to the atmosphere by way of the shift valves 7 and 8, respectively. Now, compressed air is introduced to the chambers 3*a* and 4*a* through the joints 9*a* and 10*a* of the connection so as to cause both of the valve elements 11 and 12 to be put into their open positions (see the valve position shown in FIG. 4B). This specific position is for the making-up of abrasives A, and then abrasives A stored in the recovery tank 20 are fed into the pressurized tank 21 passing through the space 17 in the storage tank 1**.

When operating an automatic operating switch on the control panel not shown, the electromagnetic shift valve 8 is energized to cause the chamber **4*b* to be put into communication with the pressure source $P_1$ and the chamber 4a opened to the atmosphere. As a consequence, the valve element 12 is now put into the closing position (see FIG. 4C). Also, the electromagnetic stop valve 16 is energized to concurrently have a timer TIM2 start counting time lapse. After the lapse of time $t_2$, the timer TIM2 completes time counting, and the timer TIM1 starts counting upon the signal of this completion. With the lapse of time $t_1$ on the timer TIM1, the electromagnetic shift valve 7 is then energized to cause the chamber 3b to be put into communication with the power source $P_1$ and the chamber 3a open to the atmosphere. Therefore, this state brings the valve element 11 into its closing position (see FIG. 4D). Upon the completion of time counting at the timer TIM1, the timer TIM2 starts counting lapse of time, and after lapse of time $t_2$ on the timer TIM2, the electromagnetic shift valve 8 is deenergized, and the chamber 4a is then put into communication with the power source $P_1$ and the chamber 4b is opened to the atmosphere. Consequently, the valve element 12 is now turned to its open position which is the state shown in FIG. 4BE. Upon the completion of time count on the timer TIM2, the timer TIM1 starts counting time lapse. Now, upon the completion of time count on the timer TIM1, the electromagnetic shift valve 8 is energized to put the chamber 4b into communication with the pressure source $P_1$, and the chamber 4a is opened to the atmosphere. As a consequence, the valve element 12 is turned to its closing position (see FIG. 4F), and in this state, the both valve elements 11 and 12 are now in their closed positions as in the state shown in FIG. 4D. Upon the completion of time count on the timer TIM1, the timer TIM2 starts counting time lapse, and upon the generation of a signal indicating the completion of time count on the timer TIM2, the electromagnetic stop valve 16 is then deenergized, whereupon the space 17, is opened to the atmosphere (see the state shown in FIG. 4G). This is the end of operating cycle, and if the switch is put in the automatic position, the blasting apparatus will turn again to the state shown in FIG. 4C noted above, the cycle of operation will then continue in repetition. When depressing the blast operation button 29 of the blasting apparatus put in its automatic operating position, abrasives A begins to be blown from the blast gun 27 onto the surface of a work to be ground and cleaned, and then is turned to be recovered by the recovery tank 20**, as stated hereinbefore.

Figure 4D:
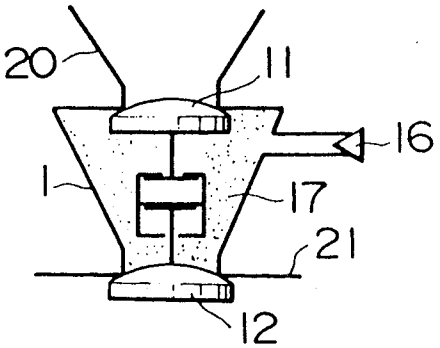
Figure 4C:
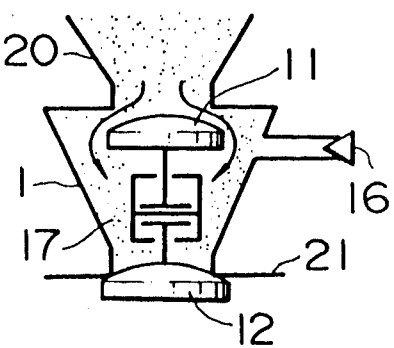
Figure 4B:
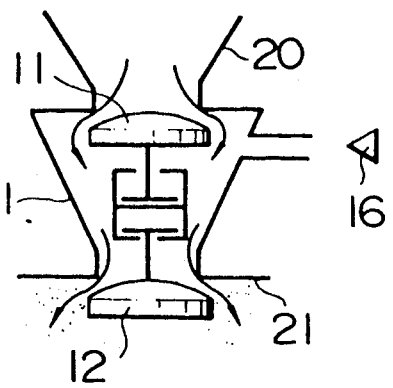

Turning more specifically to the valving operations of the involved mechanism when blasting abrasives A from the blast gun 27 in relation with the hydraulic pressure and the behavior of abrasives A, in the state shown in FIG. 4C, the internal pressure of the pressurized abrasive tank 21 is kept from leaking upwardly so as to be maintained at a specified level. On the other hand, while abrasives A are directed to be recovered in the upper recovery tank 20, as the valve element 11 is in the open position in this operating position, it is now being led down to the space 17 of the abrasive storage tank 1 so that it may accumulate therein.

It is only in the state of operation shown in FIG. 4D that abrasives A may come to accumulate in the recovery tank 20.

Figure 4G:
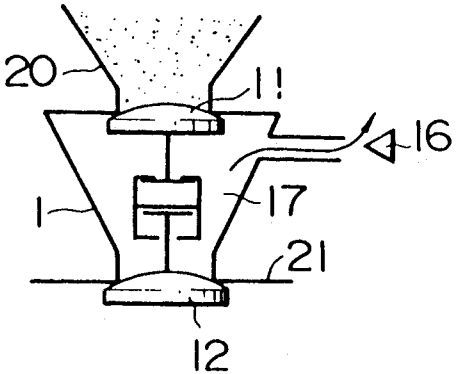
Figure 4F:
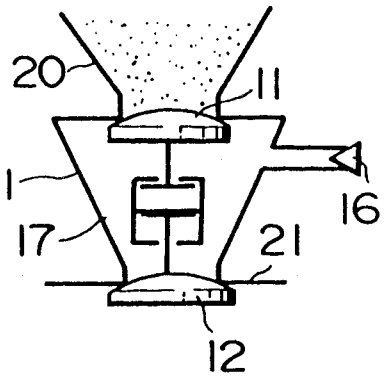
Figure 4E:
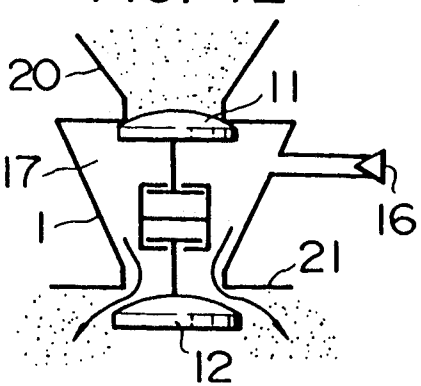

Now, in the operating state shown in FIG. 4E, abrasives A accumulated in the space 17 of the storage tank 1 are then led therefrom into the pressurized tank 21. The internal pressure of the pressurized tank 21 is held at the specified level as the valve element 11 is in the closed position.

In the state shown in FIG. 4F, the space 17 is held under the specified internal pressure, the stop valve 16 is then opened in order to have this internal pressure reduced to a desired level to the state shown in FIG. 4G.

Under this state of pressure that the internal pressure of the space 17 is now in the level of the atmosphere, when the valve element 11 is opened wherein it is again in the state shown in FIG. 4C, it is possible in practice to transfer abrasives A readily into the pressurized abrasive tank 21 without disturbing abrasives A which is likely to stay in accumulation upon the valve element 11, otherwise it might well be blown away into the upper recovery tank 20.

Once abrasive A is blown off, there would very possibly occur a phenomenon of reduction or losses of abrasives A, as it may be induced back into the suction side in the supply system, which would naturally lead to losses of the operating efficiency of the entire system, and it would consequently be essential to prevent such events from occurring.

As reviewed fully hereinbefore, by virtue of the small size of the continuously operable blasting apparatus according to the present invention, it can naturally be transported readily to the working site and carried maneuverably within a limited space in the working field, but also can work efficiently with its continuous serviceability, thereby contributing to a substantial improvement in the eventual working productivity.

While the invention has been described in detail with reference to certain preferred embodiments thereof, it is to be understood that the present invention is not restricted to such embodiments, but rather that variations and modifications may be made on the basis of the teachings of the invention without departure from the scope and spirit of the present invention.

It is to be understood that the appended claims are essentially intended to cover all of such generic and specific features as are particular to the invention as disclosed herein and all statements relating to the scope of the invention, which as a matter of language might be said to fall thereunder.

We claim:

1. A continuously-openable type hydraulic blasting apparatus comprising:

an abrasive recovery tank;

a hydraulic pressurized abrasive tank located beneath the abrasive recover tank;

abrasive storage tank means for operatively connecting the abrasive recovery tank and the hydraulic pressurized abrasive tank, said abrasive storage tank means being positioned between the abrasive recovery tank and the hydraulic pressurized abrasive tank;

first valve means connected to the abrasive storage tank means for opening the abrasive storage tank means to atmosphere;

second valve means provided in the abrasive storage tank means for opening and closing an opening between the abrasive storage tank means and the abrasive recovery tank;

third valve means provided in the abrasive storage tank means for opening and closing an opening between the abrasive storage tank means and the hydraulic pressurized abrasive tank, said second valve means and third valve means being in opposed relationship with one another;

cylinder means positioned in the abrasive storage tank means for holding the second and third valve means; and control means for independently controlling opening and closing of the first, second and third valve means such that at least said second and third valve means can simultaneously be one of both opened, both closed and one valve means opened, one valve means closed, wherein the second valve means and the third valve means both have piston rods and wherein said control means further comprises a pair of pistons, a first piston being connected to the piston rod of the second valve means and being located within a first chamber defined in the cylinder means and a second piston being connected to the piston rod of the third valve means and being located within a second chamber defined in the cylinder means, the piston rods being generally aligned along a longitudinal axis and the second and third valve means being slidably reciprocable along the longitudinal axis.

2. The hydraulic blasting apparatus as claimed in claim 1, wherein the control means further comprises means for independently applying hydraulic pressure to the first and second chambers in order to independently move the second and third valve means.

3. The hydraulic blasting apparatus as claimed in claim 2, wherein the means for applying comprises first and second joints connected to both the first and second chambers of the cylinder means and first and second shift valves, the first shift valve being connected to the first and second joint of the first chamber and the second shift valve being connected to the first and second joint of the second chamber, the first joint of each chamber being located on one side of the piston in the respective first and second chamber and the second joint of each chamber being located on another side of the piston in the respective first and second chamber, the hydraulic blasting apparatus further comprising a pressure source connected to the first and second shift valves, the first and second shift valves being movable to change the joint of the first and second chamber receiving hydraulic pressure from the pressure source such that said pistons in each chamber are movable to open and close the respective valve means.

4. The hydraulic blasting apparatus as claimed in claim 1, wherein the second valve means further comprises a valve element for sealing the opening between the abrasive recovery tank and the abrasive storage tank means, a majority of the valve element of the second valve means being positioned in the abrasive storage tank means and wherein the third valve means further comprises a valve element for sealing the opening between the abrasive storage tank means and the hydraulic pressurized abrasive tank, a majority of the valve element of the third valve means being positioned in the hydraulic pressurized abrasive tank.

5. The hydraulic blasting apparatus as claimed in claim 4, wherein the valve element of the second valve means is mounted on the first piston rod and the valve element of the third valve means is mounted on the second piston rod.

6. The hydraulic blasting apparatus as claimed in claim 1, wherein the cylinder means generally has a cylinder shape with a longitudinal axis generally aligned between the opening to the abrasive recovery tank and the opening to the hydraulic pressurized abrasive tank.

7. The hydraulic blasting apparatus as claimed in claim 1, wherein the opening between the abrasive recovery tank and the abrasive storage tank means is the sole direct opening therebetween and the opening between the abrasive storage tank means and the hydraulic pressurized abrasive tank is the sole direct opening therebetween.

8. The hydraulic blasting apparatus as claimed in claim 7, wherein the opening between the abrasive recovery tank and the abrasive storage tank means is generally aligned with the opening between the abrasive storage tank means and the hydraulic pressurized abrasive tank.

9. The hydraulic blasting apparatus as claimed in claim 1, wherein the opening between the abrasive recovery tank and the abrasive storage tank means is generally aligned with the opening between the abrasive storage tank means and the hydraulic pressurized abrasive tank.

10. The hydraulic blasting apparatus as claimed in claim 1, wherein the control means controls further controls feeding of abrasive material from the abrasive recovery tank through the abrasive storage tank means to the hydraulic pressurized abrasive tank, the control means moving the first, second and third valve means in a sequence during feeding of the abrasive material.

11. The hydraulic blasting apparatus as claimed in claim 10, wherein the control means has at least the following five sequential stages in said sequence for controlling feeding of abrasive material;

in a first stage, the control means closes the first and third valve means and opens the second valve means to feed the abrasive material from the abrasive recovery tank to the abrasive storage tank means;

in a second stage, the control means closes the first, second and third valve means;

in a third stage, the control means closes the first and second valve means and opens the third valve means to feed the abrasive material from the abrasive storage tank means to the hydraulic pressurized abrasive tank;

in a fourth stage, the control means closes the first, second and third valve means; and in a fifth stage, the control means closes the second and third valve means and opens the first valve means to vent the abrasive storage tanks means to atmosphere.

* * * * *